United States Patent [19]

Shinozawa et al.

[11] Patent Number: 4,825,675

[45] Date of Patent: May 2, 1989

[54] TOP ROLL EXCHANGING APPARATUS FOR A WHEEL RIM FORMING MACHINE

[75] Inventors: Yusaku Shinozawa, Tokyo; Minoru Takahashi, Toyohashi; Tsunoru Nakamura, Fukuoka, all of Japan

[73] Assignees: Topy Kogyo Kabushiki Kaisha, Tokyo; Watanabe Tekko Kabushiki Kaisha, Fukuoka, both of Japan

[21] Appl. No.: 109,038

[22] Filed: Oct. 16, 1987

[51] Int. Cl.[4] ..... B21H 1/10

[52] U.S. Cl. ..... 72/105; 72/238

[58] Field of Search ..... 72/105, 106, 238, 239

[56] References Cited

U.S. PATENT DOCUMENTS

| | | | |
|---|---|---|---|
| 2,154,004 | 4/1939 | Le Jeune | 72/105 |
| 3,433,045 | 3/1969 | Wilson | 72/239 |

FOREIGN PATENT DOCUMENTS

| | | | |
|---|---|---|---|
| 2905948 | 8/1980 | Fed. Rep. of Germany | 72/238 |
| 197316 | 11/1984 | Japan | 72/239 |

*Primary Examiner*—Lowell A. Larson

*Attorney, Agent, or Firm*—Cushman, Darby & Cushman

[57] ABSTRACT

A top roll exchanging apparatus for a rim shape forming machine. The top roll exchanging apparatus includes a movable bearing device for supporting a top roll shaft and a top roll loading/unloading arm provided on an extension of the top roll shaft. The movable bearing device is movable between an engaging position wherein the movable bearing device rotatably supports the top roll shaft and a waiting position wherein the movable bearing device is spaced from the extension of the top roll shaft. The top roll loading/unloading arm is movable toward and away from the top roll shaft and is rotatable about a mid-portion thereof. A top roll is exchanged by removing the movable bearing device from the engaging position, moving the top roll loading/unloading arm to load and unload top rolls and finally returning the movable bearing device to its original position.

8 Claims, 4 Drawing Sheets

TOP ROLL EXCHANGING APPARATUS FOR A WHEEL RIM FORMING MACHINE

BACKGROUND OF THE INVENTION

1. Field of the Invention

The present invention relates to wheel rim forming machines and, more particularly, to a top roll exchanging apparatus for a wheel rim forming machine.

2. Description of the Related Art

Vehicle wheels are conventionally manufactured on a disk wheel manufacture line by the following series of steps: First, a long plate of predetermined width is cut to a specified length and rolled to form a tube. The end portions of the rolled plate are then butt welded to form a one piece cylindrical element. The cylindrical element is conveyed to a flaring machine where both axial end portions of the cylindrical element is flared. The flared cylindrical element is conveyed to a wheel rim forming station which usually comprises a plurality of wheel rim forming machines arranged in series where it is press formed to produce a required rim shape. After the formation of the rim shape, the rim element is conveyed to a disk insertion station where a disk which has been manufactured on another line is inserted into the rim element. The rim element and the disk are conveyed to a welding station where they are welded together to form a disk wheel. Finally, the disk wheel is painted.

Since the diameter, width, thickness and shape of the rim element vary according to the type of wheel to be manufactured, the top roll and bottom roll of the wheel rim forming machine between which the rim element is press formed must be changed in accordance with a change in the type of wheel to be manufactured. Exchange of the bottom roll is relatively easy, because the bottom roll and a bottom roll shaft for supporting the bottom roll are axially divided to two members, respectively, and because the bottom roll shaft are supported by a fixed frame. However, exchange of the top roll is quite difficult because the top roll is supported by a rather complicated vertically driven frame structure.

More particularly, heretofore, the top roll has been exchanged as follows: First, one of the bearing devices which supports the end portions of the top roll shaft mounted with the top roll is removed so that the top roll shaft is supported only by the other bearing device in a cantilevered manner. Next, the top roll is slid along the top roll shaft and is removed from the free end thereof. Another top roll is then mounted onto the top roll shaft from the free end of the shaft. The removed bearing device is returned to its original position so that the top roll shaft is again supported at both end portions thereof. Each of the foregoing steps are performed by hand because the support structure of the top roll shaft is so complicated and no easier exchanging procedure existed. Since the bearing device and the top roll are very heavy, handling of the same is difficult and dangerous, and exchanging of the top roll takes a relatively long period of time.

SUMMARY OF THE INVENTION

An object of the present invention is to provide a top roll exchanging apparatus for a wheel rim forming machine wherein the top roll can be exchanged in an easier manner than in the prior art.

The above object can be attained by a top roll exchanging apparatus in accordance with the present invention, which comprises:

a movable bearing device for supporting one end portion of a top roll shaft on which the top roll is slidably mounted, the movable bearing device being movable in an axial direction of the top roll shaft between an engaging position where the movable bearing device engages with the top roll shaft and a disengaged position where the movable bearing device is disengaged from the top roll shaft and further being movable between the disengaged position and a waiting position where the movable bearing device is away from an extension of the top roll shaft; and a top roll loading/unloading arm provided on the extension of the top roll shaft, the top roll loading or unloading arm being movable toward or away from the top roll shaft and being rotatable around a rotational axis which extends at a right angle with respect to the top roll loading/unloading arm at a mid-portion of the top roll loading/unloading arm.

In the above apparatus, a top roll is exchanged in accordance with the steps of:

providing a movable bearing device in supporting relation to one end portion of a top roll shaft on which a top roll to be exchanged is slidably mounted;

moving the movable bearing device in an axial direction of the top roll shaft from an engaging position wherein the movable bearing device engages the top roll shaft to a disengaged position wherein the movable bearing device is disengaged from the top roll shaft;

moving said movable bearing device from the disengaged position to a waiting position wherein the movable bearing device is spaced from an extension of the top roll shaft;

mounting a top roll loading/unloading arm to the extension of the top roll shaft so as to be movable toward and away from the top roll shaft and rotatable about a vertical axis at a mid-portion of the top roll loading/unloading arm;

mounting a replacement top roll for replacing the top roll to be exchanged to one end of the top roll loading-/unloading arm;

moving the top roll loading/unloading arm toward the top roll shaft so that a second end of the rop roll loading/unloading arm engages the one end of the top roll shaft;

sliding the top roll to be exchanged from the top roll shaft to the top roll loading/unloading arm;

rotating the top roll loading/unloading arm about the vertical axis so as to align the replacement top roll with the top roll shaft;

sliding the replacement top roll from the arm to the shaft;

moving the top roll loading/unloading arm in a direction away from the top roll shaft; and moving the movable bearing device from the waiting position to the disengaged position and subsequently to the engaging position so as to support the one end portion of the top roll shaft.

According to the top roll exchanging apparatus of the present invention, a top roll is exchanged for another top roll by driving the movable bearing device and the top roll loading/unloading arm whereby heavy members such as the movable member and the top roll are supported by the movable frame and the top roll loading/unloading arm, respectively. As a result, the exchange procedure of the top roll is easy and safe in comparison with the prior art. In addition, since loading/unloading the replacement top roll onto and from the arm can be performed independently of the forming operation of the forming machine, the exchanging time can be greatly decreased.

BRIEF DESCRIPTION OF THE DRAWINGS

These and other objects and advantages of the invention will become more apparent and can be more readily appreciated from the following detailed description of the presently preferred exemplary embodiment of the invention taken in conjunction with the accompanying drawings, in which.

DETAILED DESCRIPTION OF THE PREFERRED EMBODIMENT

The wheel rim forming machine comprises a frame 15 which includes a fixed frame 23 having four vertically extending columns and a driven frame 24 which is slidably supported by fixed frame 23 and is vertically driven by a hydraulic cylinder 16 in a vertical direction.

Figure 1:
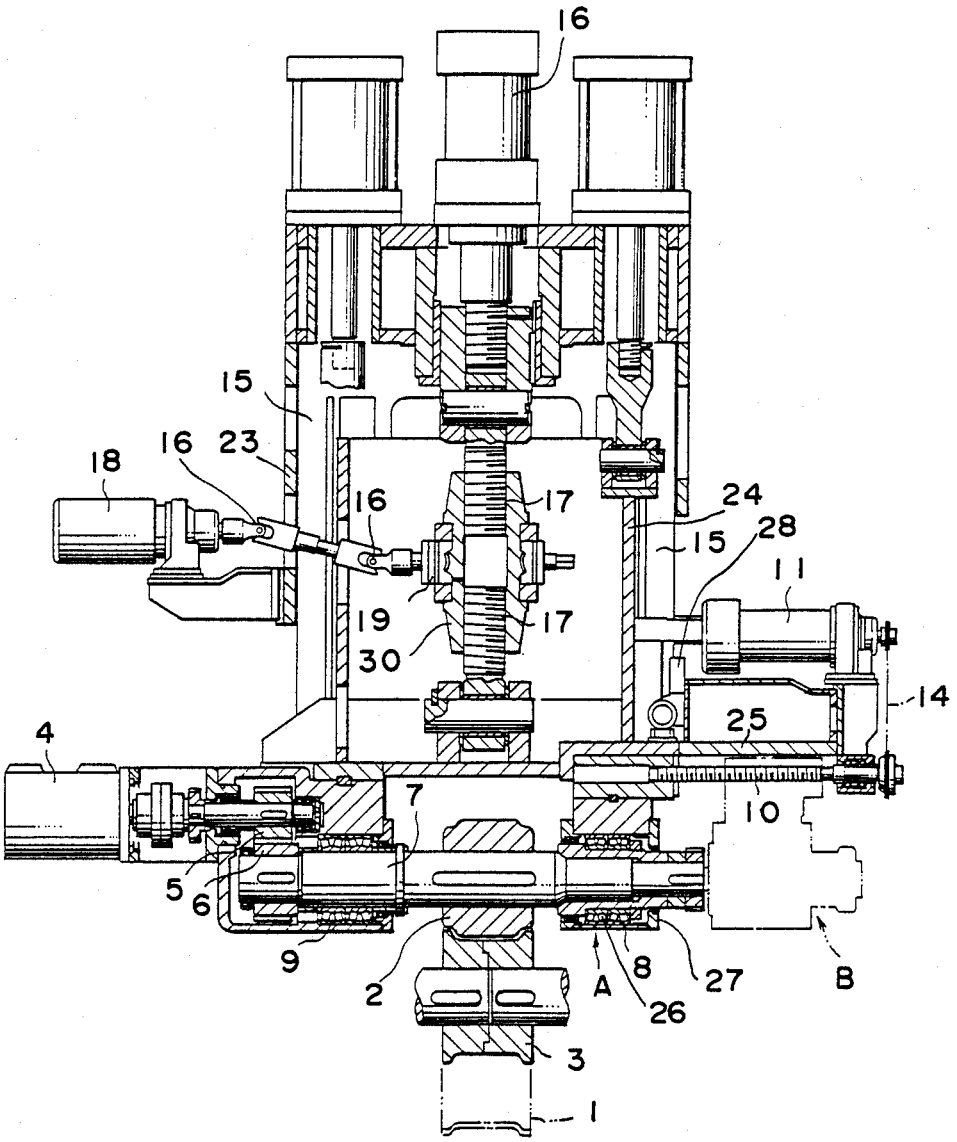
FIG. 1 is a cross-sectional view of one portion of a top roll exchanging apparatus in accordance with one embodiment of the present invention.
Figure 2:
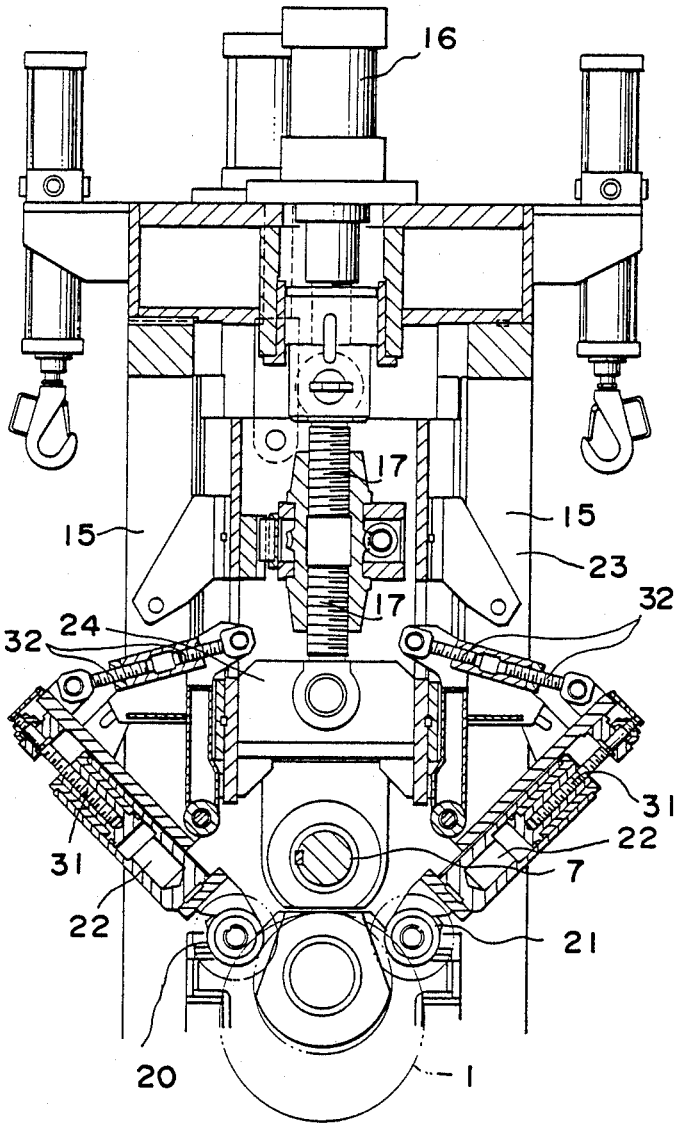
FIG. 2 is a side elevational view of the portion of the apparatus of FIG. 1.
Figure 3:
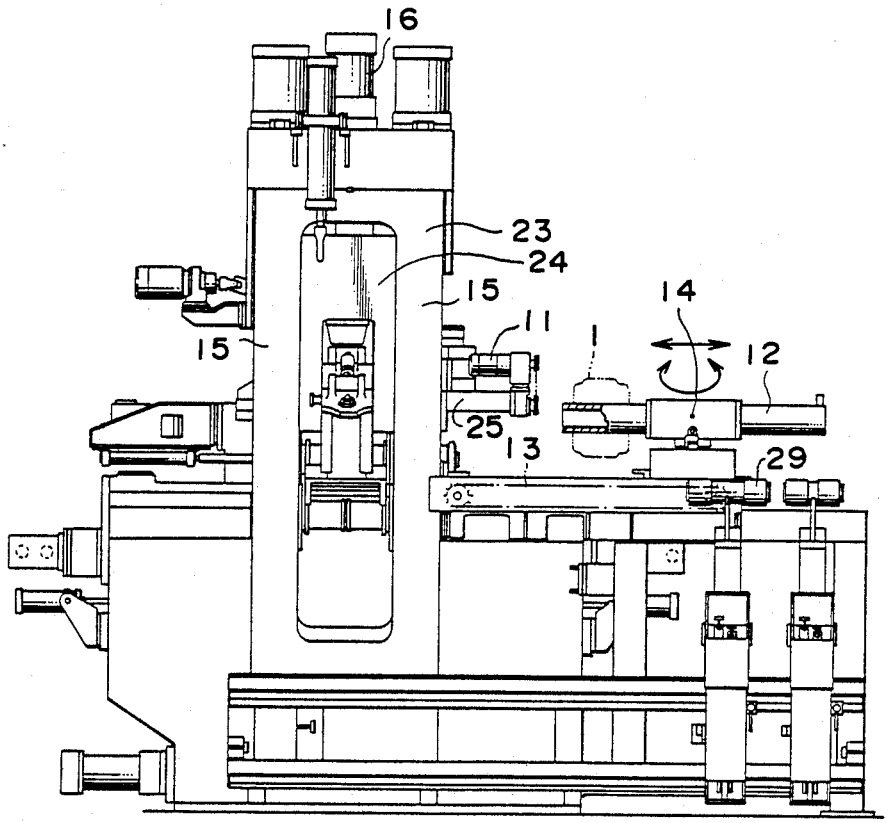
FIG. 3 is an elevational view of a wheel rim forming machine provided with the portion of the apparatus of FIG. 1.
Figure 4:
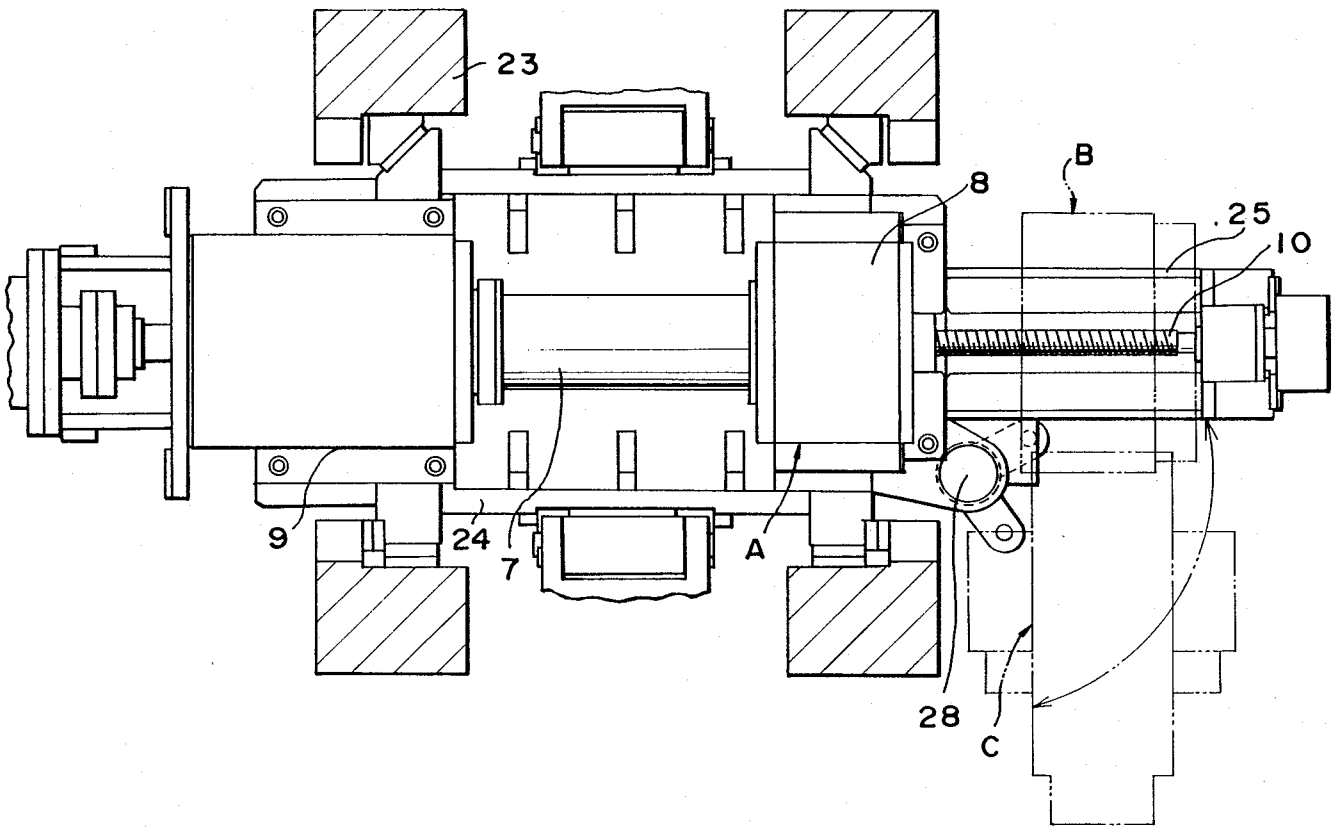
FIG. 4 is a plan view of the portion of the apparatus of FIG. 1.

A top roll 2 is supported by a top roll shaft 7 and is key-engaged therewith so that top roll 2 can rotate together with top roll shaft 7 and can slide along top roll shaft 7 in an axial direction. Top roll shaft 7 is rotatably supported by driven frame 24 with bearing devices, described more fully below, and top roll 2 is supported by driven frame so as to move therewith in the vertical direction. A bottom roll 3 comprises two roll elements supported by two bottom roll shaft elements as shown in FIG. 1 and is rotatably supported by fixed frame 23 and, thus, can not move in the vertical direction. When a rim element 1 to be formed is conveyed to a forming position of the wheel rim forming machine, the two roll elements and bottom roll shaft elements are driven inside rim element 1 and support rim element 1 from inside thereof.

Top roll 2 can be forcibly rotated by a hydraulic motor 4 which is connected to top roll shaft 7 and is supported by driven frame 24. AFter rim element 1 is supported by bottom roll 3, top roll 2 is driven downward by hydraulic cylinder 16 so that the wall of rim element 1 is squeezed between top and bottom rolls 2 and 3. When top roll 2 is forcibly rotated by hydraulic motor 4 via gears 5 and 6, the entire circumference of rim element 1 is formed to a desired rim shape.

The wheel rim forming machine is provided with a top roll exchanging apparatus which includes a movable bearing device 8 and a top roll loading/unloading arm 12. More particularly, movable bearing device 8 is one of the two bearing devices which rotatably support top roll shaft 7 at the end portions thereof. The other of the two bearing devices is a fixed bearing device 9 which is fixed to driven frame 24 so that fixed bearing device 9 can not move relative to driven frame 24 but can move therewith in the vertical direction. Movable bearing device 8 is movable in the axial direction of top roll shaft 7 between an engaging position A where movable bearing device 8 engages with top roll shaft 7 and a disengaged position B where movable bearing device 8 is disengaged from top roll shaft 7. Movable bearing device 8 is further movable between disengaged position B and a waiting position C where movable bearing device 8 is away from an extension of top roll shaft 7. Movable bearing device 8 comprises a bearing 26 and a housing 27. More particularly, movable bearing device 8 is driven between engaging position A and disengaged position B by a screw shaft 10 which threadingly engages movable bearing device 8 and is rotated by an electric motor 11 via a chain 14.

Frame 15 further includes a movable frame 25 which is pivotally connected by a coupling 28 to driven frame 24 so as to be rotatable in a horizontal plane about the axis of coupling 28. Movable bearing device 8 is adapted to be moved between driven frame 24 and movable frame 25. Thus, movable bearing device 8 is supported by driven frame 24 when it is disposed in engaging position A, and is supported by movable frame 25 when it is disposed disengaged position B or waiting position C. Further, screw shaft 10 is rotatably supported around a longitudinal axis thereof by movable frame 25 and threadingly engages housing 27, as was discussed above. Finally, motor 11 is supported by movable frame 25.

Movable bearing device 8 is moved between disengaged position B and waiting position C by manually rotating movable frame 25 around the axis of coupling 28. However, an automated means for rotating movable frame 25 such as an electric motor may be provided.

Top roll loading/unloading arm 12 is provided on an extension of top roll shaft 7 and is movable toward or away from top roll shaft 7. Thus, it can be moved between a position where either one of the end portions of arm 12 can engage the opposing end of top roll shaft 7 and a position where arm 12 does not interfere with movable bearing 8 and movable frame 25 when they are rotated around the pivot axis of coupling 28. Also, top roll loading/unloading arm 12 is mounted so as to be rotatable at least 180° in a horizontal plane around a vertical axis which extends through mid-portion 14 of arm 12.

The end portions of top roll loading/unloading arm 12 are hollow shafts such that the end portions of top roll loading/unlording arm 12 can receive an adjacent end portion of top roll shaft 7 therein when top roll loading/unloading arm 12 is driven toward shaft 7. The end portions of top roll loading/unloading arm 12 preferably have an outside diameter equal to an outside diameter of a mid-portion of top roll shaft 7 where top roll 2 is mounted on top roll shaft 7. As such, top roll 2 can shift smoothly from top roll shaft 7 to top roll loading/unloading arm 12 or from arm 12 to top roll shaft 7.

Top roll loading/unloading arm 12 is driven in an axial direction by an endless chain 13 which extends parallel to the extension of top roll shaft 7 and is operatively coupled to an electric motor 29. Top roll loading/unloading arm 12 is pivoted about mid-portion 14 manually. However, it is to be understood that an automated means for pivoting top roll loading/unloading arm 12 may be provided.

When top roll 2 is to be exchanged, the vertical position of top roll shaft 7 should be coincident with that of top roll loading/unloading arm 12. Therefore, driven frame 24 is connected to fixed frame 23 via a pair of vertically extending threaded rods 17. One of the rods has a right-threaded thread and the other has a left-threaded thread. The rods are coupled via a coupling 30 which has a threaded interior surface. By rotating coupling 30 with, for example, an electric motor 18 which is supported by driven frame 24 and is connected to coupling 30 via a plurality of universal joints 16, the distance left between rods 17 can be varied and thus an initial vertical position of top roll 2 can be adjusted.

The wheel rim forming machine further comprises a pair of guide rolls 20 and 21 which are free to rotate about their longitudinal axes and are urged toward rim element 1 by the compressed air supplied to chambers 22 so as to contact rim element 1 so that rim element 1 can rotate about its longitudinal axis without becoming misaligned. This enables exact formation of rim element 1. The direction and force with which guide rolls 20 and 21 are urged against rim element 1 can be adjusted by rotating manually adjustable screws 31 and 32.

Using the above apparatus, top roll is exchanged in the following manner: First, movable bearing device 8 is moved from engaging position A to disengaged position B through the operation of electric motor 11 and the consequent rotation of screw shaft 10. Movable bearing device 8 is further moved from disengaged position B to waiting position C by rotating movable frame 25. Thus, movable bearing device 8 is removed from engagement with top roll shaft 7. At this time, then, top roll shaft 7 is supported only by fixed bearing device 9 in a cantilevered manner.

Top roll loading/unloading arm 12 is then driven toward and engages the free end portion of top roll shaft 7. Top roll 2 to be exchanged is subsequently slid from top roll shaft 7 to the adjacent end portion of top roll loading/unloading arm 12. Arm 12 is then moved away from top roll shaft 7 so that arm 12 disengages shaft 7. At this point, top roll loading/unloading arm 12 is rotated around mid-portion 14 by 180° so that the other end portion of the arm 12 on which a substitute top roll has been mounted is brought to a position opposing to the free end of top roll shaft 7. Then, top roll loading/unloading arm 12 is again moved toward top roll shaft 7 so that the end portion of arm 12 engages the free portion of top roll shaft 7. The substitute top roll is then slid from top roll loading/unloading arm 12 to top roll shaft 7. After loading, top roll loading/unloading arm 12 is moved away from top roll shaft 7 and, finally, movable bearing device 8 is moved from waiting position C through disengaged position B to engaging position A.

Loading and unloading of a substitute top roll onto top roll loading/unloading arm 12 can be performed independent of replacing of top roll 2. Therefore, loading or unloading a substitute top roll onto or from arm 12 can be performed while the wheel rim forming machine is operating. As a result, top roll exchange time can be greatly decreased.

In the above procedure of exchanging a top roll, a worker need not carry or support heavy members such as top rolls and bearing devices, unlike the prior art. Accordingly, top rolls can be exchanged very easily and very safely.

Although only one embodiment of the present invention has been described in detail above, those skilled in the art will readily appreciate that many modifications of the exemplary embodiment are possible without materially departing from the novel teachings and advantageous features of the present invention. Accordingly, all such modifications are intended to be included within the scope of the present invention as defined in the following claims.

What is claimed is:

1. A top roll exchanging apparatus for a wheel rim forming machine having a fixed frame and a vertically driven frame wherein a rim element for a disk wheel is formed by squeezing a cylindrical element having flared end portions between a top roll supported by the vertically driven frame and a bottom roll supported by the fixed frame, comprising, in combination:

a movable bearing device for supporting one end portion of a top roll shaft on which a top roll to be exchanged is slidably mounted, said movable bearing device being movable in an axial direction of said top roll shaft between an engaging position wherein said movable bearing device is supported by said vertically driven frame and engages with said top roll shaft and a disengaged position wherein said movable bearing device is disengaged from said top roll shaft and further being movable between said disengaged position and a waiting position wherein said movable bearing device is away from an extension of said top roll shaft;

a movable frame means pivotally coupled to said vertically driven frame for supporting said movable bearing device when said movable bearing device is disposed in said disengaged position and said waiting position, said movable bearing device being moved between said disengaged positon and said waiting position by horizontal rotation of said movable frame means relative to said vertically driven frame;

a screw shaft supported by said movable frame means, coupled to said movable bearing device and operatively coupled to a motor means for rotating said screw shaft around a longitudinal axis of said screw shaft to cause said screw shaft to drive said movable bearing device between said engaging position and said disengaged position; and a top roll loading/unloading arm mounted to the extension of said top roll shaft so as to be movable toward and away from said top roll shaft and rotatable about a vertical axis extending through a mid-portion of said top roll loading/unloading arm.

2. The top roll exchanging apparatus according to claim 1, further comprising a fixed bearing device coupled to a vertically driven portion of said wheel rim forming machine and fixed in the axial direction of said top roll shaft, said top roll shaft being supported by said movable bearing device at one end portion thereof and being supported by said fixed bearing device at the other end portion thereof.

3. The top roll exchanging apparatus according to claim 1, wherein said fixed frame comprises four vertically extending columns, two adjacent columns of the four vertically extending columns defining therebetween a space for movement of said movable bearing device between said engaging position and said disengaged position.

4. The top roll exchanging apparatus according to claim 1, wherein each end portion of said top roll loading/unloading arm includes a hollow shaft for receiving an end portion of said top roll shaft therein when said top roll loading/unloading arm is driven toward said top roll shaft.

5. The top roll exchanging apparatus according to claim 4, wherein said end portion of said top roll loading/unloading arm has an outside diameter substantially equal to an outside diameter of a mid-portion of said top roll shaft to which said top roll is mounted.

6. The top roll exchanging apparatus according to claim 4, further comprising an endless chain connected to said top roll loading/unloading arm, said endless chain extending parallel to an extension of said top roll shaft and means, connected to said endless chain, for driving said endless chain so as to move said arm toward and away from said top roll shaft.

7. The top roll exchanging apparatus according to claim 1, wherein said top roll loading/unloading arm is rotatable about said vertical axis at least about 180°.

8. A method of exchanging a top roll in a wheel forming machine having a fixed frame, a vertically driven frame vertically driven relative to said fixed frame, and a movable frame means pivotally coupled to said vertically driven frame and horizontally movable relative to said vertically driven frame, wherein a rim element for a wheel is formed by squeezing a cylindrical element between a top roll supported via a top roll shaft by said vertically driven frame and a bottom roll supported by said fixed frame, said top roll shaft being supported, via a movable bearing device at one end portion of said top roll shaft and a fixed bearing device at the other end portion of said top roll shaft, by said vertically driven frame, said movable bearing device and said top roll being slidably mounted on said top roll shaft, said method comprising the steps of:

moving said top roll shaft, said top roll and said movable bearing device vertically upwardly by moving said vertically driven frame upwardly relative to said fixed frame and said bottom roll;

moving said movable bearing device in an axial direction of said top roll shaft from an engaging position wherein said movable bearing device engages said top roll shaft to a disengaged position wherein said movable bearing device is disengaged from a top roll shaft by rotating a horizontally extending screw shaft, supported by said movable frame means and coupled to said movable bearing device, by operating a motor means operatively coupled to said screw shaft;

moving said movable bearing device from said disengaged position to a waiting position wherein said movable bearing device is spaced from an extension of said top roll shaft by horizontally rotating said movable frame means relative to said vertically driven frame;

mounting a top roll loading/unloading arm to the extension of said top roll shaft so as to be movable toward and away from said top roll shaft and rotatable about a vertical axis at a mid-portion of said top roll loading/unloading arm;

mounting a replacement top roll for replacing said top roll to be exchanged to one end of said top roll loading/unloading arm;

moving said top roll loading/unloading arm toward said top roll shaft so that a second end of said top roll loading/unloading arm engages said one end of said top roll shaft;

sliding said top roll to be exchanged from said top roll shaft to said top roll loading/unloading arm;

rotating said top roll loading/unloading arm about said vertical axis so as to align the replacement top roll with said top roll shaft;

sliding said replacement top roll from said arm to said shaft;

moving said top roll loading/unloading arm in a direction away from said top roll shaft;

moving said movable bearing device from said waiting position to said disengaged position by rotating said movable frame means relative to said vertically driven frame and subsequently to said engaging position by rotating said screw shaft by operating said motor means so as to support said one end portion of said top roll shaft; and moving said top roll, said movable bearing device and said top roll shaft vertically downwardly by moving said vertically driven frame downwardly.

* * * * *